US005619925A

United States Patent [19]

Seefried

[11] Patent Number: 5,619,925

[45] Date of Patent: Apr. 15, 1997

[54] CLEANING DEVICE FOR CYLINDERS OF A PRINTING PRESS

[75] Inventor: Karl-Heinz Seefried, Zuzenhausen, Germany

[73] Assignee: Heidelberger Druckmaschinen AG, Heidelberg, Germany

[21] Appl. No.: 437,277

[22] Filed: May 8, 1995

[30] Foreign Application Priority Data

May 6, 1994 [DE] Germany ..... 44 16 127.1

[51] Int. Cl.[6] ..... B41F 35/00

[52] U.S. Cl. ..... 101/423; 101/425

[58] Field of Search ..... 101/423, 425, 101/424; 15/256.52

[56] References Cited

U.S. PATENT DOCUMENTS

| | | | |
|---|---|---|---|
| 3,763,778 | 10/1973 | Sills et al. | 101/426 |
| 4,015,307 | 4/1977 | Kossak | 101/425 |
| 4,072,106 | 2/1978 | Junghans et al. | 101/425 |
| 5,035,178 | 7/1991 | Jahn et al. | 101/425 |
| 5,265,537 | 11/1993 | Gasparrini et al. | 101/423 |
| 5,317,969 | 6/1994 | Tateishi | 101/425 |

FOREIGN PATENT DOCUMENTS 7933305 3/1980 Germany .

*Primary Examiner*—Edgar S. Burr
*Assistant Examiner*—Anthony H. Nguyen
*Attorney, Agent, or Firm*—Herbert L. Lerner; Laurence A. Greenberg

[57] ABSTRACT

Cleaning device for a cylinder of a printing press wherein the cylinder is formed with at least one cylinder gap open at the cylinder circumference and extending in the direction of the cylinder axis, the cleaning device including a beam-type cleaning tool extending over the length of the cylinder gap and disposed so as to be movable transversely to the cylinder axis against the cylinder and into the cylinder gap, includes a swivel shaft disposed parallel to the axis of the cylinder, the cleaning tool being connected to the swivel shaft so as to be swivelable thereabout into engagement with the cylinder and into the cylinder gap for brushing against walls defining the cylinder gap and removing adhering dirtied cleaning liquid therefrom.

5 Claims, 3 Drawing Sheets

CLEANING DEVICE FOR CYLINDERS OF A PRINTING PRESS

BACKGROUND OF THE INVENTION

Field of the Invention

The invention relates to a cleaning device for cylinders of a printing press and, more particularly, for cylinders, respectively, formed with at least one cylinder gap open at the cylinder circumference and extending in the direction of the cylinder axis, the cleaning device including a beam-type cleaning tool extending over the length of the cylinder gap and disposed so as to be movable transversely to the cylinder axis.

Washing devices for the cylinder jackets of the cylinders of a printing press have become known heretofore. Such washing devices, as disclosed in the published German Patent Document DE 79 33 305 U1, use a cleaning tool which, having been saturated or soaked with cleaning liquid, is pressed transversely to the cylinder axis against the circumference of the cylinder and, after termination of the cleaning operation, is withdrawn. In this regard, the cleaning tool is mounted eccentrically and is formed with a hexagonal cross section. At the end of the cylindrical jacket surface, the cleaning tool is moved into the cylinder gap a slight distance and is thereby stepped up to the next side surface. The latter thereafter again reaches or comes into contact with the rubber-blanket jacket surface.

In the process of washing a cylinder, especially a blanket cylinder of a sheet-fed offset printing press, washing liquid unavoidably gets into the cylinder gap quite frequently and, in fact, to an increased extent when washing media based upon a vegetable origin is used. The washing medium is wiped in the region of the gap bordering on the cylinder jacket, and adheres thereat to the wall defining the gap. When pressure contact is made again, the soiled or dirty washing liquid which has gotten into the gap sprays or spatters onto the printed stock due to the then higher rotary speed of the cylinder, so that the printed material is unusable initially, until the cylinder gap has been cleaned of adhering washing-medium residue by centrifugal force.

SUMMARY OF THE INVENTION

It is therefore an object of the invention to provide a device for cleaning a cylinder of a printing press wherein washing-medium residue is prevented from being sprayed or spattered out of the cylinder gap.

With the foregoing and other objects in view, there is provided, in accordance with the invention, a cleaning device for a cylinder of a printing press wherein the cylinder is formed with at least one cylinder gap open at the cylinder circumference and extending in the direction of the cylinder axis, the cleaning device including a beam-type cleaning tool extending over the length of the cylinder gap and disposed so as to be movable transversely to the cylinder axis against the cylinder and into the cylinder gap, comprising a swivel shaft disposed parallel to the axis of the cylinder, the cleaning tool being connected to the swivel shaft so as to be swivelable thereabout into engagement with the cylinder and into the cylinder gap for brushing against walls defining the cylinder gap and removing adhering dirtied cleaning liquid therefrom.

In accordance with another feature of the invention, the cleaning device includes respective bell cranks having respective arms whereon respective ends of the cleaning tool are disposed, the bell cranks having respective other arms by which the bell cranks are mounted on the swivel shaft, and also includes respective pneumatic cylinders to which the bell cranks, respectively, are articulatedly connected.

In accordance with a further feature of the invention, the swivel shaft is journaled in a bearing on a housing of a cylinder-washing device which is engageable with and disengageable from the circumference of the cylinder.

In accordance with an added feature of the invention, the swivel shaft, whereon the one end of the cleaning tool is disposed, is axially displaceable for removing the cleaning tool, and is withdrawable from the bearing on the housing of the cylinder-washing device.

In accordance with an additional feature of the invention, the cylinder-washing device has driven components, and the cleaning tool is a brush roller connected via transmission elements with the driven components of the cylinder-washing device.

In accordance with a concomitant feature of the invention, the cylinder-washing device has drive elements for driving the swivel shaft via a pinion, the transmission elements forming a belt transmission connecting the swivel shaft and the brush roller.

Thus, the cleaning tool according to the invention, during the swiveling movement thereof into the gap, can completely remove the washing-medium residue adhering to the side gap walls due to the advantageous construction of the cleaning tool. In this regard, a rotatingly driven brush roller with automatic cleaning by a squeegee, a wiper or the like is preferred. The cleaning tool, movably disposed on a part of the printing-press frame, can be moved into the gap by means of a manual lever in order to remove any adhering cleaning-agent residue from the wall of the gap. Preferably, the cleaning tool, by means of a swiveling movement thereof about a swivel shaft situated parallel to the axis of the cylinder, is moved against the cylinder and into the gap in order thereby to achieve a movement of the cleaning tool which matches the contour of the wall of the gap. Preferably, both ends of the cleaning tool are disposed on one arm, respectively, of a respective bell crank, the bell cranks being held by the other arms, respectively, thereof on a swivel shaft and being articulatedly connected to a respective pneumatic cylinder. The air cushion in the pneumatic cylinders permits the cleaning tool to be flexibly and elastically pressed against the wall of the gap when the cleaning tool dips into the gap, thereby permitting the cleaning tool, when it re-emerges from the gap, to retract elastically against the air cushion in the pneumatic cylinders.

A particularly advantageous embodiment of the invention provides for a combination of such a cleaning device with a device for washing the circumference or jacket surface of a cylinder in a printing press. For this purpose, the two bell cranks are held by one arm on a housing of a cylinder-washing device which is engageable with and disengageable from the circumference or jacket surface of the cylinder. In this connection, it is particularly advantageous if the swivel shaft, which bears the cleaning tool at one end, is axially displaceable for removing the cleaning tool and is withdrawable from its bearing on the housing of the washing device.

This permits a rapid replacement of the cleaning tool. Other features which are considered as characteristic for the invention are set forth in the appended claims.

Although the invention is illustrated and described herein as embodied in a device for cleaning cylinders of a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
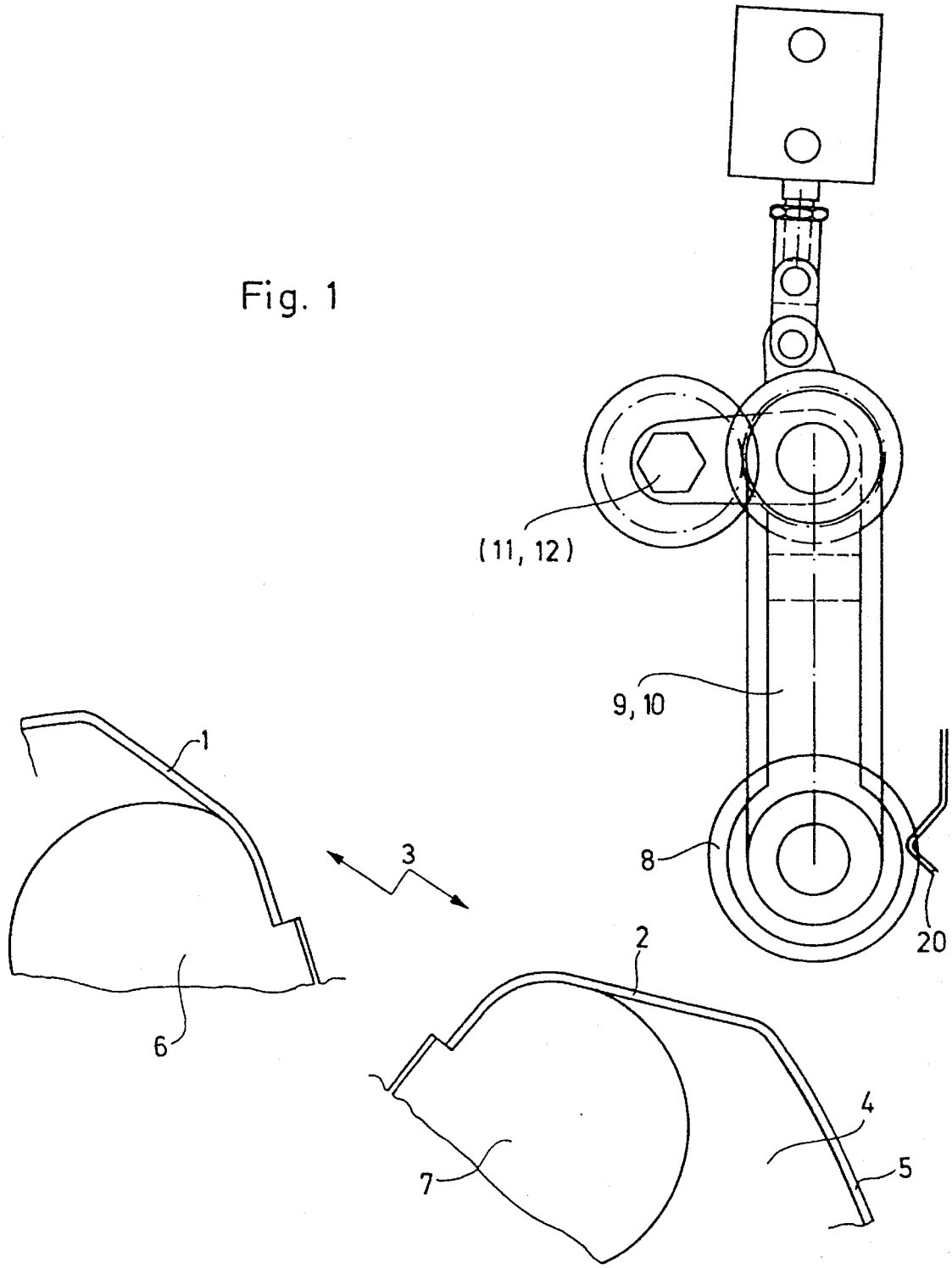
FIG. 1 is a side elevational view of a cleaning device according to the invention in conjunction with a diagrammatic cross-sectional view of a cylinder formed with a cylinder gap to be cleaned.

Referring now to the drawings and, first, particularly to FIG. 1 thereof, there is shown therein an embodiment of the cleaning device according to the invention for cleaning side walls 1 and 2 of a circumferentially open cylinder gap 3 of a rubber-blanket cylinder 4 of a sheet-fed rotary offset printing press. Respective ends of a rubber blanket 5 surrounding the cylinder 4 are attached to respective tensioning devices 6 and 7 which are disposed in the gap 3 and permit a controlled tensioning of the rubber blanket 5.

Figure 2:
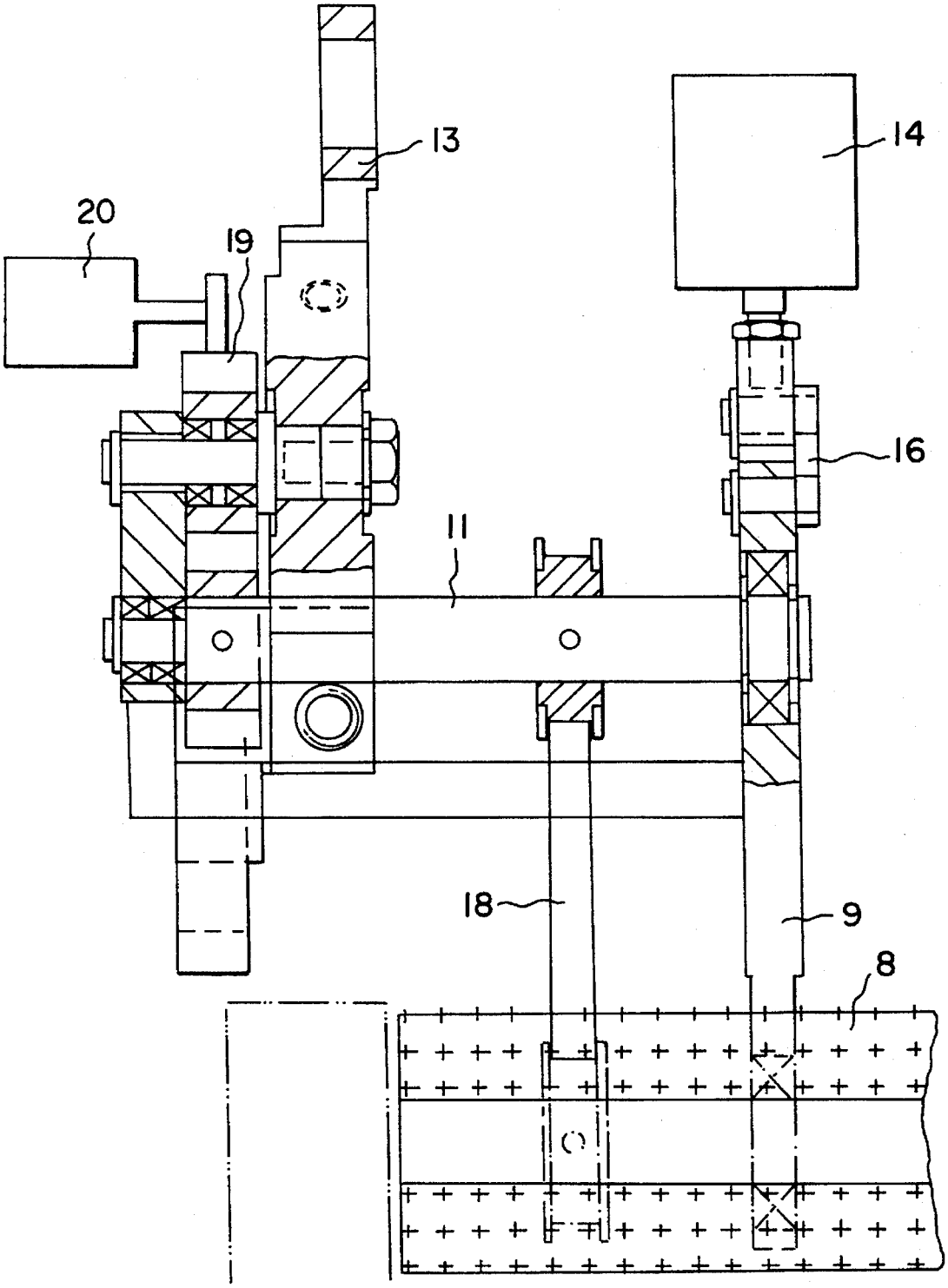
FIG. 2 is a sectional view of the cleaning device at a drive side of a printing press.
Figure 3:
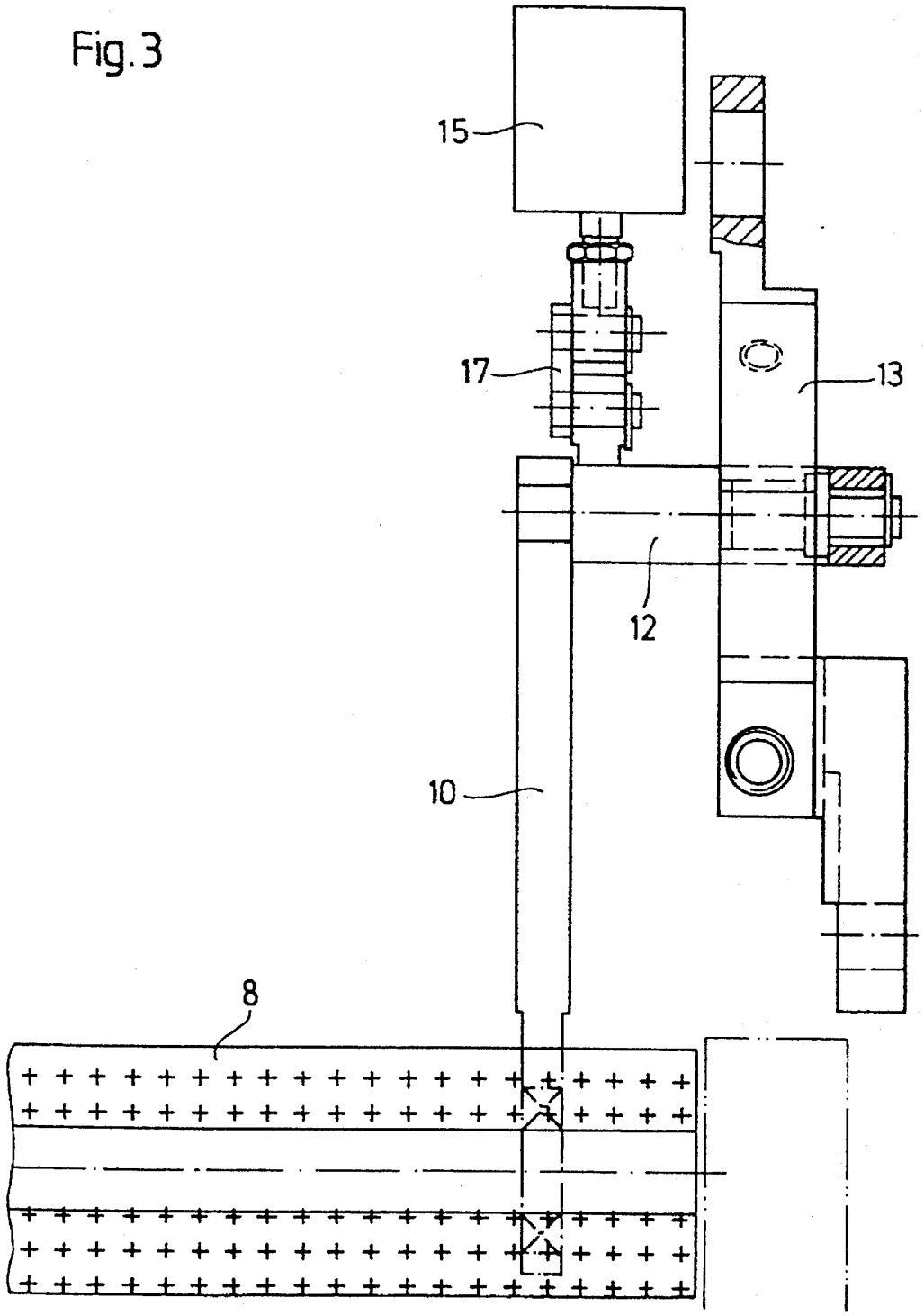
FIG. 3 is a sectional view of the cleaning device at an operating side of the printing press.

The cleaning device is provided with a brush roller 8, both ends of which are journaled, respectively, in an arm of a bell crank 9,10. The other end of each bell crank 9,10 is journaled in a respective swivel shaft 11,12 which, in turn, as shown in FIG. 2, is mounted on a housing 13 of a non-illustrated washing device for the rubber blanket 5. At least at one side of the printing press, the respective swivel shaft 11,12 is secured against axial movement by means of easily removable securing members, so that the respective swivel shaft 11,12 can be removed quite readily in order to disassemble the brush roller 8 therefrom. As shown in FIGS. 2 and 3, a respective pneumatic cylinder 14,15 is connected to the respective bell crank 9,10 by means of respective straps 16,17. By actuating the respective pneumatic cylinders 14, 15, the respective bell cranks 9,10 can be swivelled about the respective swivel shafts 11,12, so that the brush roller 8 executes a swiveling movement on an arcuate path, which permits the brush roller to contact the cylinder-gap walls 1 and 2 adjacent to the cylinder jacket. The brush roller 8 is driven at one end thereof by a belt transmission 18 from the rotatably driven swivel shaft 11. The drive for the swivel shaft 11 is derived from the drive of the otherwise non-illustrated washing device by means of a pinion 19. For this purpose, provision is made for the rotational speed of the washing device for the rubber blanket, at the end of the washing operation, to be shifted down to a lower rotational speed, at which the pinion 19 is connected to the drive of the washing device. At the same time, the pneumatic cylinders 14 and 15 are energized, so that the then rotating brush roller sweeps, with a swiveling motion, along the lateral cylinder-gap walls 1 and 2, from which it removes any adhering dirt or soil residues. After this cylinder-gap cleaning operation, the printing press can be re-accelerated to the operating speed and the washing program of the washing device can be continued. The brush roller 8 is cleaned, for example, by means of a squeegee or wiper blade 20, which engages the bristles of the brush roller 8.

I claim:

1. Cleaning device for a cylinder of a printing press wherein the cylinder is formed with at least one cylinder gap open at the cylinder circumference and extending in the direction of the cylinder axis, the cleaning device including a beam and a cleaning tool mounted on said beam extending over the length of the cylinder gap, and said tool being mounted to be movable transversely to the cylinder axis against the cylinder and into the cylinder gap, comprising a swivel shaft disposed parallel to the axis of the cylinder, said cleaning tool being connected to said swivel shaft so as to be swivelable thereabout into engagement with the cylinder and into said cylinder gap for brushing against walls defining the cylinder gap and removing adhering dirtied cleaning liquid therefrom.

2. Cleaning device according to claim 1, including respective bell cranks having respective arms upon which respective ends of said cleaning tool are disposed, said bell cranks having respective other arms by which said bell cranks are mounted on said swivel shaft, and including respective pneumatic cylinders to which said bell cranks, respectively, are articulatedly connected.

3. Cleaning device according to claim 1, wherein said swivel shaft is journaled in a bearing.

4. Cleaning device according to claim 3, wherein said swivel shaft, upon which said one end of said cleaning tool is disposed, is axially displaceable for removing said cleaning tool, and is withdrawable from said bearing.

5. Cleaning device according to claim 1, wherein said cleaning tool is a brush roller connected via transmission elements with driven components of a cylinder-washing device.

* * * * *